United States Patent [19]

Vollinger

[11] Patent Number: 4,470,757

[45] Date of Patent: Sep. 11, 1984

[54] SIDEPLATE RETENTION FOR A TURBINE ROTOR

[75] Inventor: Gary J. Vollinger, East Hartford, Conn.

[73] Assignee: United Technologies Corporation, Hartford, Conn.

[21] Appl. No.: 352,485

[22] Filed: Feb. 25, 1982

[51] Int. Cl.[3] ..... F01D 5/32

[52] U.S. Cl. ..... 416/221; 416/193 A; 416/220 R; 416/219 R

[58] Field of Search ..... 416/193 A, 220 R, 221, 416/219 R

[56] References Cited

U.S. PATENT DOCUMENTS

| | | | |
|---|---|---|---|
| 2,847,187 | 8/1958 | Murphy | 416/221 |
| 2,985,426 | 5/1961 | Hunter | 416/193 A |
| 3,479,009 | 11/1969 | Bean | 416/193 A |
| 3,598,503 | 8/1971 | Muller | 416/221 |
| 3,632,228 | 7/1972 | Acres | 416/220 |
| 3,778,185 | 12/1973 | Plowman et al. | 415/214 |
| 4,101,245 | 7/1978 | Hess | 416/193 A |

*Primary Examiner*—Stephen Marcus
*Assistant Examiner*—Kwon John
*Attorney, Agent, or Firm*—Norman Friedland

[57] ABSTRACT

The sideplates of a turbine rotor assembly that seal between turbine stages are retained by a retention assembly that hooks onto the front sideplate and is riveted onto the rear plate negating the necessity of rivet holes in the front sideplate. A plurality of segmented sideplates circumscribe the full hoop of the rotor and each sideplate carries a retention assembly rather than providing a retention assembly for each blade which is greater in number.

3 Claims, 3 Drawing Figures

SIDEPLATE RETENTION FOR A TURBINE ROTOR

DESCRIPTION

1. Technical Field

This invention relates to gas turbine engines and particularly the retention means of the sideplate assemblies of the first stage of the high pressure turbine rotor.

2. Background Art

In a typical gas turbine engine the turbine blades of the first stage (that sees the highest temperature) is retractably mounted in a turbine disc or hub. To seal the juncture point where the roots of the blades are secured into the disc, sideplates are held into position by a rivet passing through both sideplates and each blade would require such a retention construction.

With the advent of the higher speeds and higher temperature that the turbines encounter in the more fuel efficient types of jet engines, the use of the above mentioned retention means is unsatisfactory. The hole receiving the rivet in the fore sideplate of the first stage turbine creates high stress concentration point and consequently, because of the hostile environment, it impairs the life thereof.

I have found that I can avoid the problems noted above by providing a unique retention means that avoids the necessity of putting a hole through the fore sideplate. By virtue of this invention, a single retention means is utilized for each group of blades constituting a segment within the segmented aft sideplate rather than having a retention means for each blade has heretofore been the case.

DISCLOSURE OF INVENTION

An object of this invention is to provide for the fore and aft sideplates where the aft sideplates are segmented about the rear face of the disc of the first stage turbine of a jet engine and, which spans the juncture where the turbine blades are supported, improved retention means. A feature of this invention is to provide a spring-like element that is riveted to the aft segmented sideplate and hooked to the fore side of the disc that supports the aft segmented sideplate without imposing a hole in the fore sideplate.

Other features and advantages will be apparent from the specification and claims and from the accompanying drawings which illustrate an embodiment of the invention.

BEST MODE FOR CARRYING OUT THE INVENTION

For the sake of convenience and simplicity, the details of a gas turbine engine where this invention is preferably utilized, is omitted from the description herein, but reference should be made to the JT9D and 2037 engine models manufactured by Pratt & Whitney Aircraft Group, division of United Technologies Corporation, the assignee of this patent application incorporated herein by reference. The invention replaces the retention means disclosed in U.S. Pat. No. 3,733,146 and constitutes an improvement thereover. Suffice it to say that this invention has primary utility in the first stage turbine that encounters an extremely hostile environment in the gas turbine engine.

Figure 1:
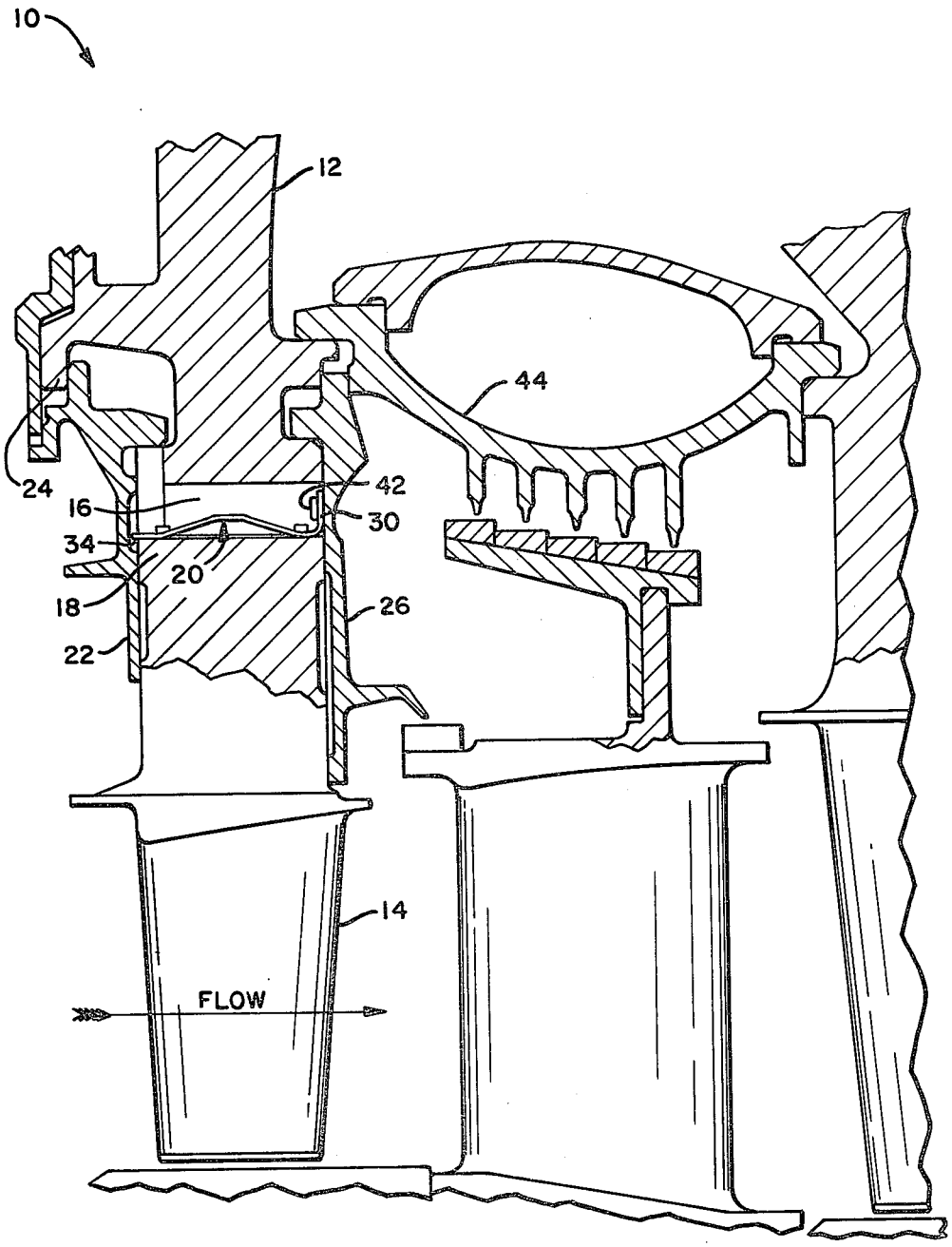
FIG. 1 is a fragmentary view partly in section and partly in elevation showing the first and second row of turbine blades and a portion of their discs.

As noted from FIG. 1, the first stage generally indicated by reference numeral 10 comprises a disc 12 suitably mounted to the turbine shaft (not shown) to which is supported a plurality of circumferentially spaced turbine blades 14 (one being shown). Also, it is typical to provide a gap 16 between the root 18 of the blades and the recess formed in the disc for receiving the root. The retention means generally indicated by reference numeral 20 are disposed herein and as will be explained in more detail hereinbelow, serve to retain the rear or aft sideplate.

As can be seen by referring to FIG. 1, the sideplates serve to seal the junction point made between the disc and the root of the blade when mounted in the disc recess. The fore sideplate 22 may take the form of a full hoop and is retained in position by the forward disc flange member 24. The aft sideplate 26 which comprises a plurality of circumferentially mounted segments (one being shown and in this instance 12 forming the complete hoop) is retained by the retention mechanism.

Figure 2:
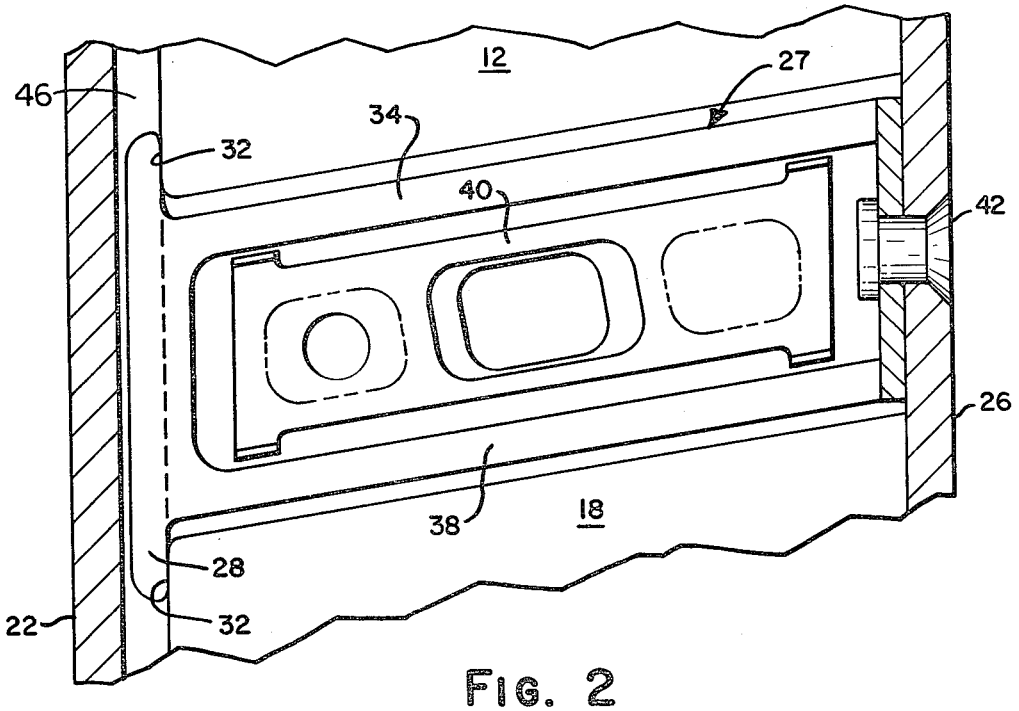
FIG. 2 is an elevated view of the retention means mounted between the disc and the turbine blade at the point of attachment and illustrates the invention.
Figure 3:
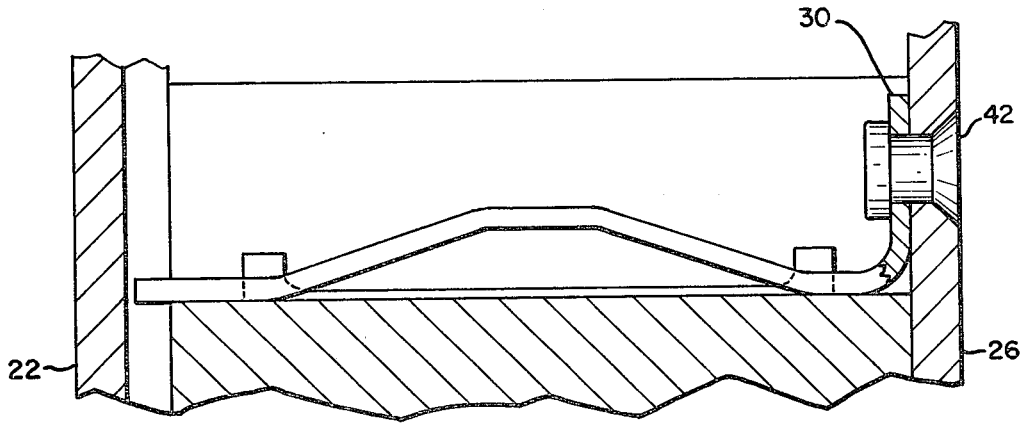
FIG. 3 is a side view partly in section and partly in elevation of the retention means as assembled in FIG. 2.

As was alluded to in the above, it has been the heretofore practice to rivet the fore to the aft plates to hold them into place and each blade would have its own rivet. For example, an arrangement of this construction is shown in U.S. Pat. No. 3,733,146 granted to S. L. Smith and P. E. Voyer on May 15, 1973 and assigned to the assignee of this patent application. According to this invention as best seen by referring to FIGS. 2 and 3, the retention means 20 comprises a stamped-out sheet metal member 27 having a hook portion 28 formed on one end and an upstanding portion 30 lying contiguous to the forward face of the aft sideplate 26. The hook portion carries laterally spaced tangs 32 and extend into the cavity portion 46 formed on the rear face of the fore sideplate 22 and hook on to the front face of disc 12. The stamped-out sheet metal member is formed with a central opening so that a pair of legs 34 and 38 extend axially in a direction from the front to rear of said blade 14 and straddle the metering plate 40 that typically serves to provide cooling flow internally of the blade.

The upstanding portion 30 is riveted by rivet 42 to the aft sideplate to hold the retaining means into place and hence, secures the fore sideplate into position. The legs 34 and 38 of the stamped member are bent upwardly in order to provide a spring-like effect (see particularly FIG. 3) and spring load the plates and afford a positive pull on the sideplate during assembly of the rotor. The lenticular seal 44 spanning the adjacent spaced turbine rotor assemblies loads the sideplates when the engine is in operation. A more detailed explanation of the lenticular seal and its function is described in U.S. Pat. No. 3,733,146, supra, and reference should be made thereto.

From the foregoing it is apparent that the aft sideplate is fully supported without introducing drilled holes in the fore sideplate and hence eliminate stress concentration points. The unit is relatively simple, easy to fabricate and assemble. A removable type rivet (not shown) is contemplated within the scope of this invention to replace the rivet 42 in the event that a removable retaining mechanism is desired. Such a device may be advantageous for the balancing procedure accompanying the assembly of the turbine to the engine. As noted above, the fastening mechanism saves weight by virtue of the fact that it eliminates a need for having a retainer for each blade rather than having one retainer for each segment. In a forty-eight blade rotor and a twelve segmented sideplate installation, this eliminates thirty-six retainers.

It should be understood that the invention is not limited to the particular embodiments shown and described herein, but that various changes and modifications may be made without departing from the spirit and scope of this novel concept as defined by the following claims.

I claim:

1. For a gas turbine engine having a row of turbine blades supported in a turbine disc, retention means for fore and rear sideplates adapted to seal off the juncture at the point where said turbine blades and said turbine disc supported thereby meet, said rear sideplates formed from a plurality of circumferentially disposed segments being mounted adjacent the rear side of said turbine blades adjacent said juncture relative to the flow of working medium passing therethrough, a spring-like element having outwardly projecting tab members engaging the fore side of said turbine disc behind its adjacent fore sideplate and extending transversely through the recess formed in said turbine disc adjacent the root end of one of said turbine blades, an upstanding end on said spring-like element adjacent one of the rear sideplates and fastener means extending from said upstanding end for securing said retention means to each of said segments whereby said retention means holds said rear sideplates in contiguous relationship with said turbine blades and said turbine disc adjacent said juncture.

2. Retention means as in claim 1 wherein said spring-like element includes a relatively flat member having a pair of opposing legs, said legs being bent upwardly relative to the planar surface of said flat member.

3. Retention means as in claim 2 wherein said fastener fashion means includes a rivet.

* * * * *

UNITED STATES PATENT AND TRADEMARK OFFICE

CERTIFICATE OF CORRECTION

PATENT NO. : 4,470,757

DATED : September 11, 1984

INVENTOR(S) : Gary J. Vollinger

It is certified that error appears in the above-identified patent and that said Letters Patent is hereby corrected as shown below:

Column 4, line 20, delete --fashion--.

Signed and Sealed this

*Twenty-first* Day of *May 1985*

[SEAL]

*Attest:*

DONALD J. QUIGG

*Attesting Officer* *Acting Commissioner of Patents and Trademarks*